US008206270B2

(12) United States Patent
Skipper

(10) Patent No.: US 8,206,270 B2
(45) Date of Patent: Jun. 26, 2012

(54) APPARATUS AND METHOD FOR TEMPORARY MOUNTING OF A HANGBOARD

(76) Inventor: Ryan M. Skipper, Orlando, FL (US)

( * ) Notice: Subject to any disclaimer, the term of this patent is extended or adjusted under 35 U.S.C. 154(b) by 0 days.

(21) Appl. No.: 12/752,906

(22) Filed: Apr. 1, 2010

(65) Prior Publication Data

US 2011/0245040 A1 Oct. 6, 2011

(51) Int. Cl.
*A63B 21/00* (2006.01)

(52) U.S. Cl. ..... 482/40; 482/904; 482/37

(58) Field of Classification Search ..... 482/39, 482/904, 40

See application file for complete search history.

(56) References Cited

U.S. PATENT DOCUMENTS 5,417,628 A * 5/1995 Vanderbleek ..... 482/40
D633,156 S * 2/2011 Caswell et al. ..... D21/679
2005/0250619 A1* 11/2005 Daikeler et al. ..... 482/40

OTHER PUBLICATIONS

Iron Gym; The Ultimate Upper Body Workout & Nutrition Guide; 2008 Profit; pp. 1-9.
www.instructables.com; No Screws or Holes Pull Up Bar/Door Gym; pp. 1-6.
www.angelfire.com; Bodyweight; pp. 1-22.

* cited by examiner

*Primary Examiner* — Jerome W Donnelly
(74) *Attorney, Agent, or Firm* — Ferdinand M. Romano, Esq.; Beusse Wolter Sanks Mora & Maire, P.A.

(57) ABSTRACT

According to one embodiment a removable assembly provides for mounting of a hangboard including a first unit and at least a first bracket for connecting the hangboard to the first unit. The first unit may include a first member configured to be placed over a door opening on a first side of a wall and a second member which can be positioned across the opening and against a second side of the wall. A third member is configured for attachment to the second member such that when the first member is placed over the opening and the second member is positioned against the second side of the wall, at least a portion of the third member is positioned above the second member. A related method provides a removable assembly for mounting of a hangboard. Numerous other embodiments are disclosed.

8 Claims, 13 Drawing Sheets

4

APPARATUS AND METHOD FOR TEMPORARY MOUNTING OF A HANGBOARD

FIELD OF THE INVENTION

This invention relates to temporary mounting of athletic equipment and, more specifically, to provision of an assembly for mounting of exercise equipment including conditioning devices useful to the sport or rock climbing.

BACKGROUND OF THE INVENTION

Climbing is a sport of wide popularity. Whether a climber is experiencing the artificial environment of a recreational facility, or a natural outdoor experience, there is often a desire among enthusiasts to improve performance through a training regimen which enhances muscular capabilities. During off-seasons training can be had on large walls at commercial gymnasiums or on smaller walls that may be constructed in residential environments. It has also become popular to use a variety of smaller devices to improve, for example, strength of fingers, forearms, biceps and back muscles. Many climbers also find interest in training with specific climbing holds. To this end, it has become popular to make or purchase finger boards and hangboards. Hang boards are specifically designed to provide exercises suitable for climbers. They include a series of holds and support multiple pulling positions. A well-designed hangboard is an important tool for training. Hangboards which include a variety of hand positions are often preferred for training. With such a variety, the user can avoid over-exercising with a limited number of holds, and possibly reduce the likelihood of injuries such as a tendonitis. Home-made units offer the opportunity to customize the hold patterns, but a number of commercially available devices appear to provide many of the specific holds and pockets that individuals often desire for personal training.

Generally, hangboards are well-suited for permanent mounting in residential environments. They are relatively small and, when mounted over a door opening, they do not directly interfere with other living activities. A reason that these relatively small, mounted hangboards are popular is that they permit a person to train with a variety of exercises while remaining in the comfort and privacy of a private dwelling. When securely placed over a door opening, the mounting provides the user with necessary clearance to perform a series of holds and other exercises without physically contacting a wall.

FIG. 1 illustrates a permanent mounting arrangement for a hangboard 1 above a door opening. A backer board 2, cut from a sheet of plywood, is screwed or otherwise attached to framing members within the wall above the door opening. Then the hangboard 1 is attached to the backer board with screws. Pre-formed hangboards normally include holes through which the screws or bolts pass from the front side of the hangboard in order to effect attachment to the backerboard. Due to the forces placed on the mounted unit during use, it may be desirable to secure the hangboard to the backerboard with anchored bolts that penetrate the wall sheathing.

BRIEF SUMMARY OF THE INVENTION

According to one embodiment of the invention, a removable assembly is provided for temporary mounting of a hangboard in a walkthrough opening along a wall having first and second opposing sides. The wall typically may include a supportive strip positioned above the opening along the first side of the wall. The removable assembly comprises a first unit and a first bracket for connecting the hangboard to the first unit. The first unit includes first, second, third and fourth members. The first member is configured to be placed over the strip and along the first side of the wall when mounting the hangboard. The second member is configured for attachment to the first member in a deployed configuration wherein the second member can be positioned across the opening and against the second side of the wall while the first member is positioned over the strip. The third member is configured for attachment to the second member in the deployed configuration such that when the first member is placed over the strip and the second member is positioned against the second side of the wall, at least a portion of the third member is positioned above the second member. At least a pair of fourth members are configured to connect the first, second and third members to one another to effect the deployed configuration so that, when the first member is positioned over the strip and the second member is positioned against the second side of the wall, a load is transferable from the third member through the fourth members to the wall. The first bracket comprises a first attachment portion configured to support the hangboard and a second attachment portion configured for releasable coupling to the third member for support of the first bracket so that when (i) the first unit is positioned with the first member over the strip and the second member against the second side of the wall, (ii) and the hangboard is attached to the bracket via the first attachment portion, (iii) and the bracket is coupled to the third member via the second attachment portion: the hangboard is supported by the first unit with the second attachment portion of the bracket supported by the third member. In an exemplary embodiment, the assembly includes a second bracket also comprising a first attachment portion configured for connection to the hangboard and a second attachment portion configured for releasable coupling to the third member for support of the first bracket. Also, the second attachment portion of the first bracket and the second attachment portion of the second bracket may each be formed in a curved shape so that each bracket may be hung from the third member to support the hangboard from the first unit. In one series of embodiments the second attachment portion of the first bracket and the second attachment portion of the second bracket are each formed in a shape such that each bracket may be hung from the third member to effect the releasable coupling to the third member.

According to another series of embodiments, a removable assembly is provided for temporary mounting of a hangboard in a walkthrough opening formed along a wall having first and second opposing sides, the wall including a supportive strip positioned above the opening along the first side of the wall. The removable assembly comprises a first unit and a first bracket for connecting the hangboard to the first unit. The first unit includes first, second and third members. The first member is configured to be placed over the strip and along the first side of the wall when mounting the hangboard. The second member attached to the first member in a deployed configuration wherein the second member can be positioned across the opening and against the second side of the wall while the first member is positioned over the strip. The third member is configured for attachment to the first and second members to effect the deployed configuration so that, when the first member is positioned over the strip and the second member is positioned against the second side of the wall, a load is transferable through the third member to the wall. The first bracket comprises a first attachment portion configured to support the hangboard and a second attachment portion configured for releasable coupling to the third member for support of the first bracket. When (i) the first unit is positioned with the first member over the strip and the second member against the second side of the wall, (ii) and the hangboard is attached to the bracket via the first attachment portion, (iii) and the bracket is coupled to the third member via the second attachment portion, the hangboard is supported by the first unit with the second attachment portion of the bracket supported by the third member. According to one such embodiment, in the deployed configuration a portion of the third member is positioned above the second member. Also according to one embodiment, the portion of the third member positioned above the second member includes a segment for directly receiving a load from the hangboard via the first bracket and when the assembly is mounted in a door opening over a horizontal floor surface, with the second member positioned across the opening and against the second side of the wall, while the first member is positioned over the strip and against the first side of the wall: the segment of the second member is in a vertical orientation with respect to the floor surface. Also, the second attachment portion of the first bracket may include an end portion sized to effect a sliding inserting relationship with an end of the third member and the bracket so that, with insertion of one of the bracket or the third member into the other, the bracket becomes engaged to the first unit in a releasable coupling relationship for support of the hangboard by the first unit.

A method is also provided for temporary mounting of a hangboard in an opening along a wall having first and second opposing sides. The wall may include a supportive strip positioned above the opening along the first side of the wall. The method includes providing a first unit and providing at least a first bracket for connecting the hangboard to the first unit. Providing the first unit includes providing a first member configured for placement over the strip and along the first side of the wall when mounting the hangboard; providing a second member configured for attachment to the first member in a deployed configuration wherein the second member can be positioned across the opening and against the second side of the wall while the first member is positioned over the strip; providing a third member configured for attachment to the second member in the deployed configuration such that when the first member is placed over the strip and the second member is positioned against the second side of the wall, at least a portion of the third member is positioned above the second member; and providing at least a fourth member, configured to connect the first, second and third members to one another to effect the deployed configuration so that, when the first member is positioned over the strip and the second member is positioned against the second side of the wall, a load is transferable from the third member through the fourth member to the wall. Providing the first bracket includes providing a first attachment portion on the bracket configured to support the hangboard and providing a second attachment portion on the bracket configured for releasable coupling to the third member for support of the first bracket so that when (i) the first unit is positioned with the first member over the strip and the second member against the second side of the wall, (ii) and the hangboard is attached to the bracket via the first attachment portion, (iii) and the bracket is coupled to the third member via the second attachment portion: the hangboard is supported by the first unit with the second attachment portion of the bracket supported by the third member with attachment of the hangboard being effected with direct attachment to the bracket or attachment to the bracket via a backerboard positioned between the hangboard and the bracket.

Components in numerous embodiments may be formed of wood, plastic or metal, and the members may be formed of tubular sections attachable to each other, for example, with fasteners extending through one or more holes formed in each.

Summarily, according to numerous embodiments of the invention, a first member is configured to be placed over a strip, e.g., a piece of door trim, positioned above an opening and along the first side of a wall. A second member, attached to the first member, can be fixedly positioned across the opening and against the second side of the wall when the first member is positioned over the strip. A third member is attached to the second member such that when the first member is placed over the strip and the second member is positioned against the second side of the wall, at least a portion of the third member is positioned to receive one or more brackets that support a hangboard so that the hangboard is supported about the opening.

BRIEF DESCRIPTION OF THE DRAWINGS

The present invention can be more easily understood and the advantages and uses thereof more readily apparent when the following detailed description of the present invention is read in conjunction with the figures wherein:

FIG. 6A is a perspective view of a first unit of the assembly, FIG. 6B illustrates details of a connection in the first unit, FIG. 6C illustrates a second unit of the assembly which can be releasably coupled to the first unit.

In accordance with common practice, the various described device features are not drawn to scale, but are drawn to emphasize specific features relevant to the invention. Like reference characters denote like elements throughout the figures and text.

DETAILED DESCRIPTION OF THE INVENTION

Before describing in detail the particular methods and apparatuses relating to the invention, it should be observed that the present invention resides primarily in a novel and non-obvious combination of elements and method steps. So as not to obscure the disclosure with details that will be readily apparent to those skilled in the art, certain conventional elements and steps have been presented with lesser detail, while the drawings and the specification describe in greater detail other elements and steps pertinent to understanding the invention. Also, the following embodiments are not intended to define limits as to the structure or method of the invention, but only to provide exemplary constructions. The embodiments are permissive rather than mandatory and are illustrative rather than exhaustive.

Figure 1:
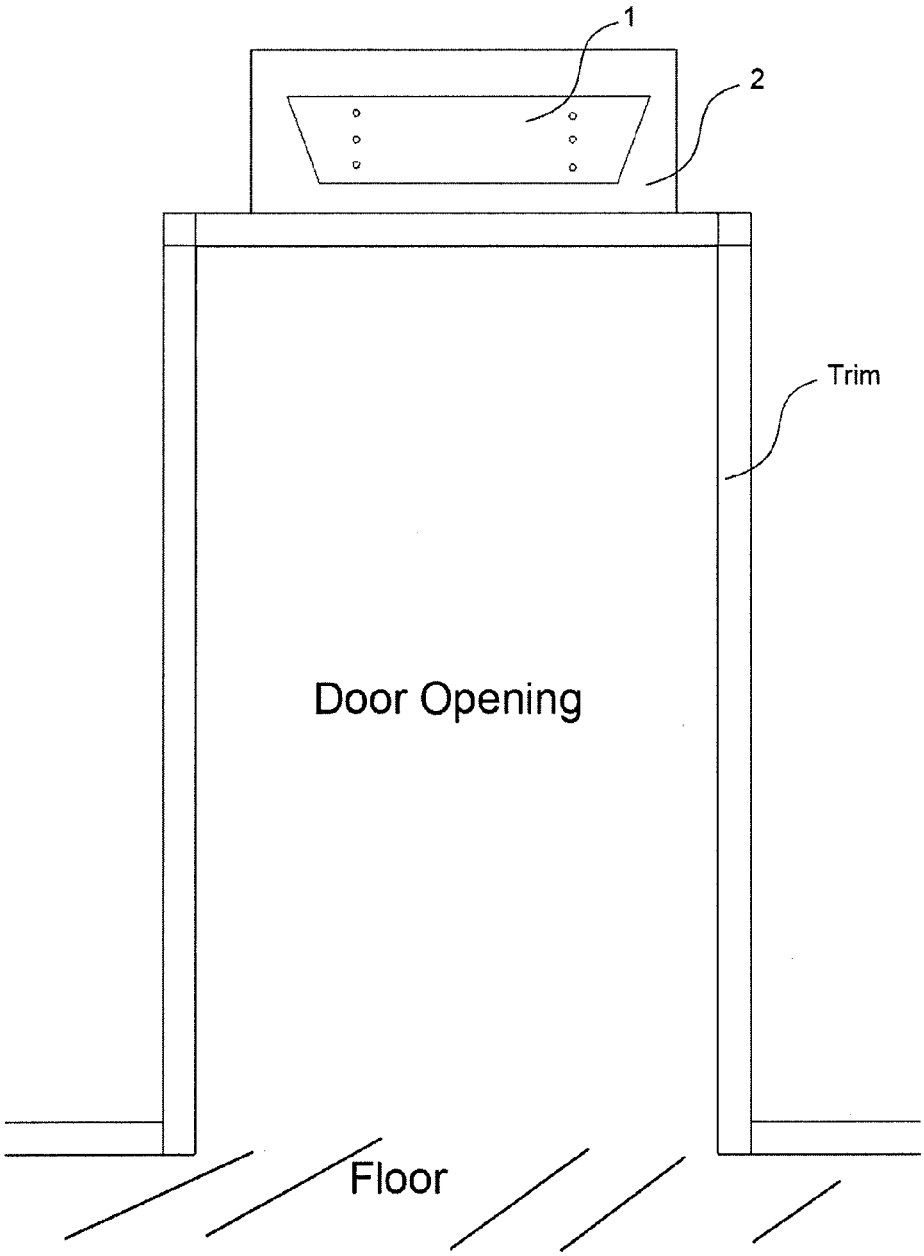
Figure 1 PRIOR ART
FIG. 1 illustrates an exemplary prior art permanent mounting arrangement for a hangboard.

For the unskilled person, conventional installation of a hangboard such as shown in FIG. 1 can be somewhat inconvenient and time consuming. After cutting the backerboard to a suitable size, installation has typically required locating multiple studs for supporting the backerboard, accurate placement of holes through the backerboard, drywall and wood studs, and secure mounting of the system with screws, bolts or nails so that the system is firmly fastened to the studs. Installation may also be prone to errors. For example, it is not uncommon to drill a hole into drywall which does not pass through a wall stud as desired. Because wall studs are generally not visible to the installer, there is also opportunity position a mounting screw close to an edge of the stud instead of more securely in a center region of the stud. This can compromise the strength of the mounting.

Once installed in the conventional manner, the hangboard is permanently mounted. It would be impractical for a user to repeatedly install and remove such a hangboard mounting. In fact, if one were to repeatedly remove screw fasteners from wood framing and reinstall them multiple times, the integrity of the mounting may be compromised as the screws may not grip the framing members as securely as desired.

Thus a permanently mounted hangboard typically remains in place for an extended period, i.e., months or years at a time, and can become an eyesore if not mounted in a discrete location. Further, the mounted hangboard is simply not portable. Thus if a user is traveling or desires to train with others, or move the exercise equipment to a different room, there is a time consuming inconvenience of disassembly and reassembly. Also, once the mounting arrangement is removed, the portion of the wall which includes drilled holes will become exposed and may require drywall patching and painting for restoration to the original appearance.

As used herein, the terms vertical and horizontal refer to orientations with respect to a ground plane and a vertical plumb line which are substantially perpendicular to one another. For example, a conventional rectangular door opening is understood to be positioned over a floor area having a substantially horizontal orientation. The opening will often be formed with a header or other framing members which provide a horizontal top plate against which wallboard and finish or jam material are often applied. Often, an upper segment of door trim is horizontally positioned along one or both sides of the wall above the door opening, perpendicular to a pair of parallel trim pieces which extend from the horizontal floor to the upper segment of horizontal door trim.

The term bracket as used herein refers to a structural member for supporting a weight, e.g., a hanging weight.

Typically, in addition to door openings, many other walk through wall openings; include finish material wrapping the opening, with trim attached along one or both of the opposing wall surfaces which border the opening. In many residential applications, the trim is typically a wood or a resinous material, including a pair of vertical segments attached along parallel upright sides of the opening and a horizontal segment attached to framing members along the top of the opening. Embodiments of the invention are illustrated in the context of such a conventional opening between rooms in a dwelling having such trim placed thereabout. However, it is to be understood that with little or no adaptation, most other walk through wall openings are suitable for use of the invention. Such openings may be formed along walls finished with a variety of materials including drywall, masonry and wood. In some instances, when one side of the opening does not include trim formed thereabout it may be necessary to fix a horizontal member along the top of the opening on one side of the wall in order to hang an assembly according to the invention.

As used herein the term wall means any combination of structural wall components, alone or in combination with any wallboard or sheathing placed along each side of the wall, as well as any door frame materials and other materials, including trim. The wall may be an interior or exterior wall of any building and may be load bearing. Generally, reference to a horizontal piece of trim positioned above an opening is understood to be a piece of finished wood which is attached to an associated door frame, or opening, or to structural members in the wall; and which is positioned against adjoining vertical pieces of trim. With such a variety of styles and designs, including split jam door frames, when door trim provides support to an assembly according to the invention, there can nonetheless be a static arrangement wherein the horizontal trim piece can transfer a required load to adjoining members. If this is not satisfactory, it may be necessary to strengthen the attachment of the horizontal trim piece to the wall or door frame, or provide an additional horizontal member which is suitably attached to the wall or door frame to support a desired load.

Figure 2A:
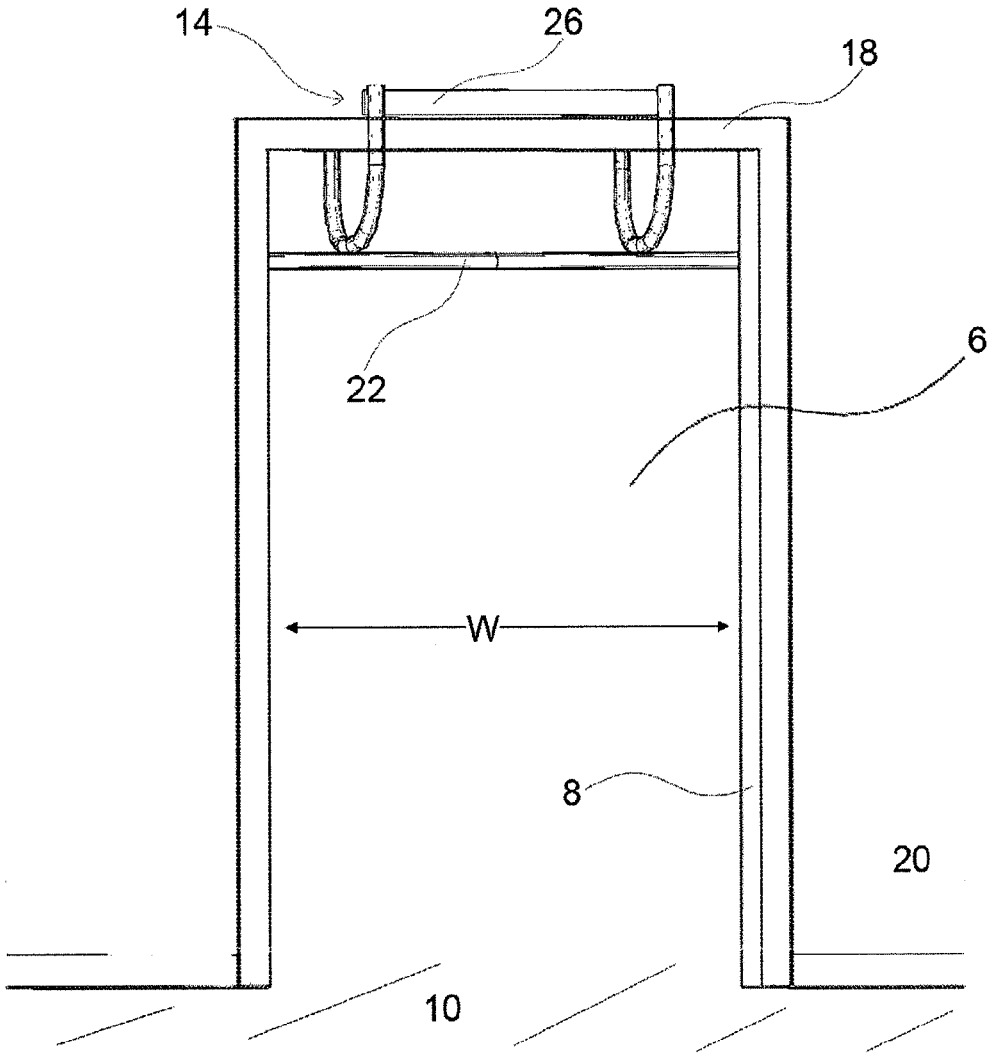
FIGS. 2A and 2B are elevation views taken from different sides of the same wall to illustrate attachment of a unit of an assembly according to an embodiment of the invention wherein the unit is shown temporarily mounted about an opening in the wall.
Figure 2B:
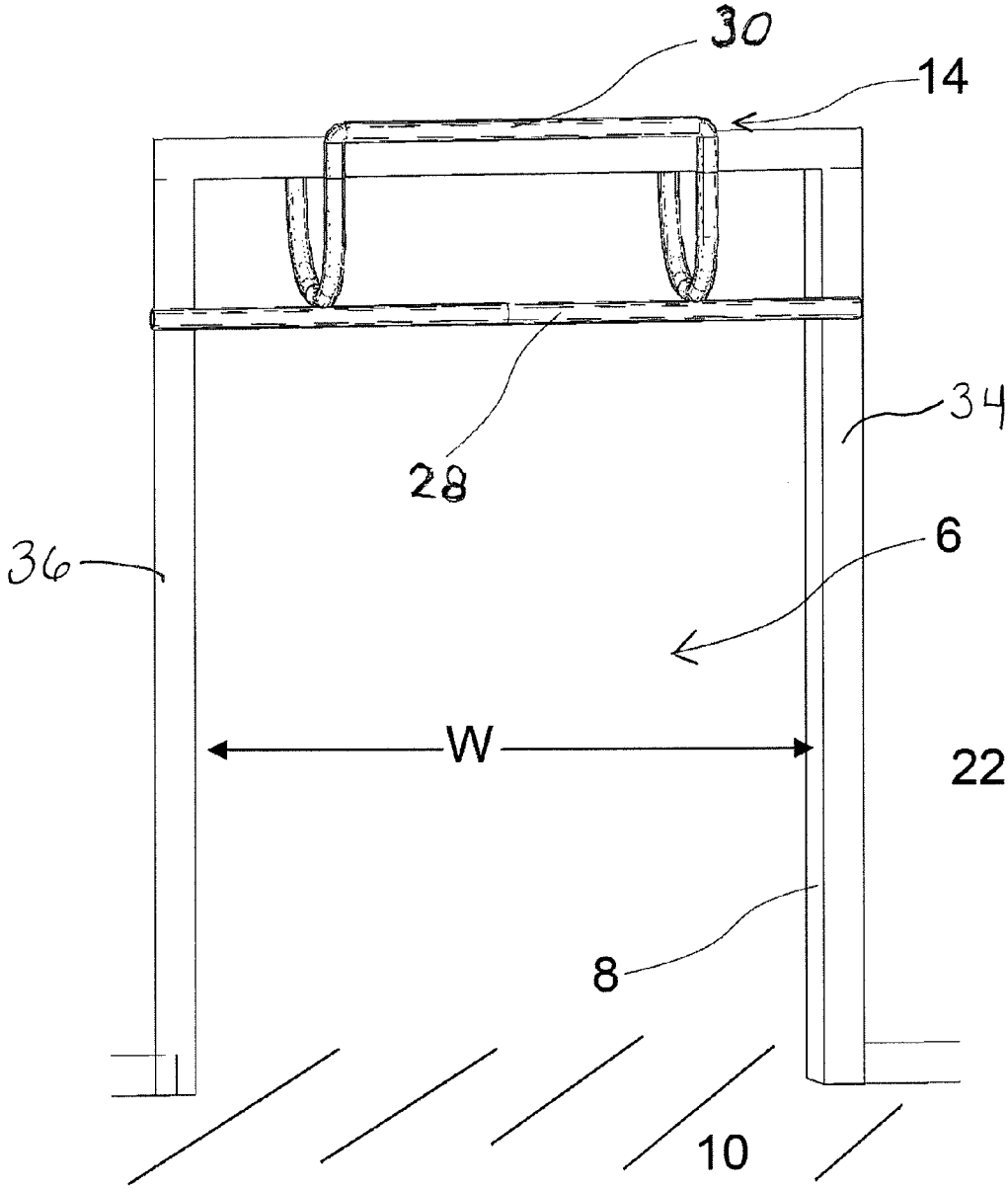
Figure 3A:
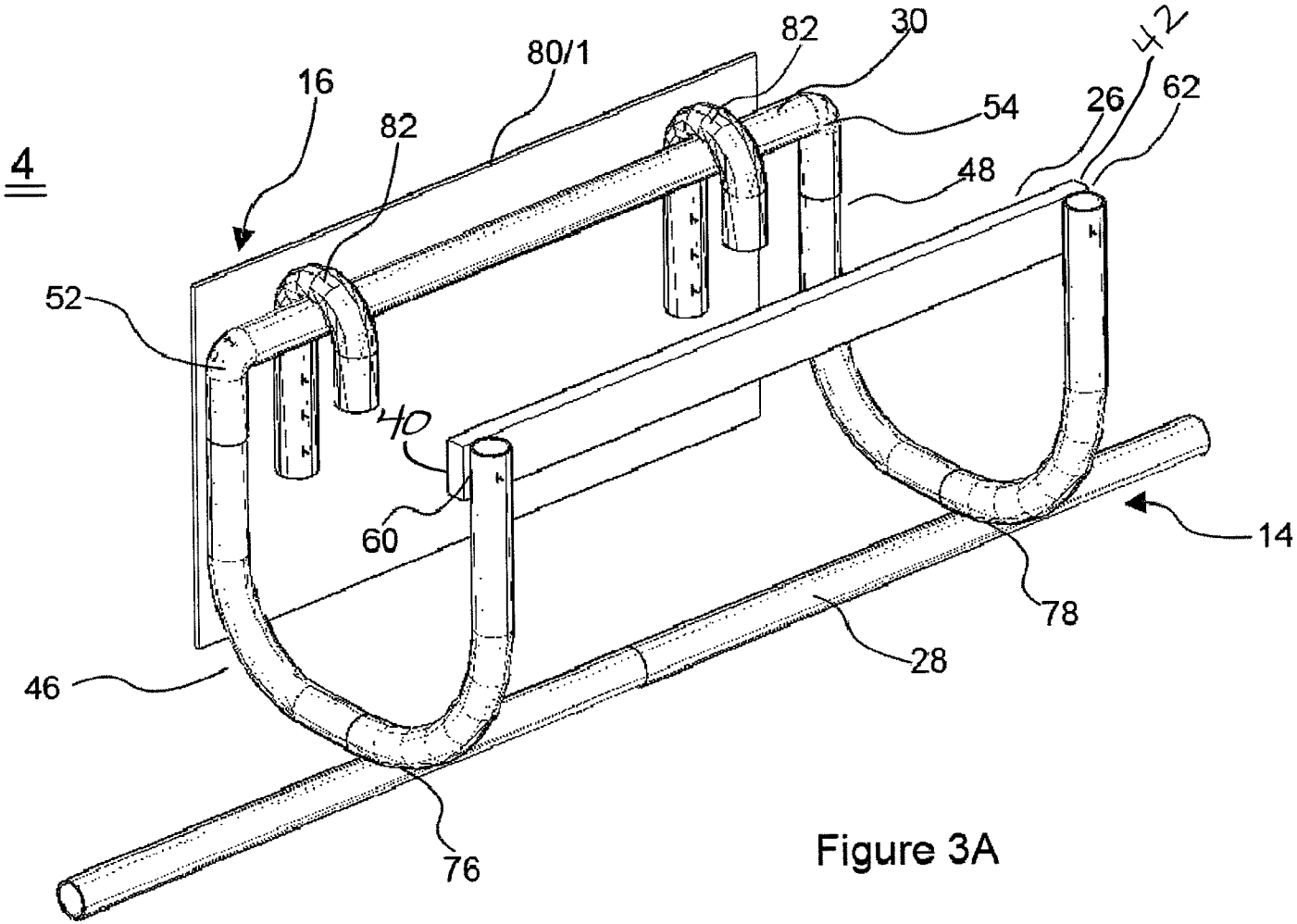
FIGS. 3A and 3B are, respectively, front and rear perspective views of the assembly according to FIG. 2, further illustrating brackets and an optional backerboard for mounting a hangboard.
Figure 3B:
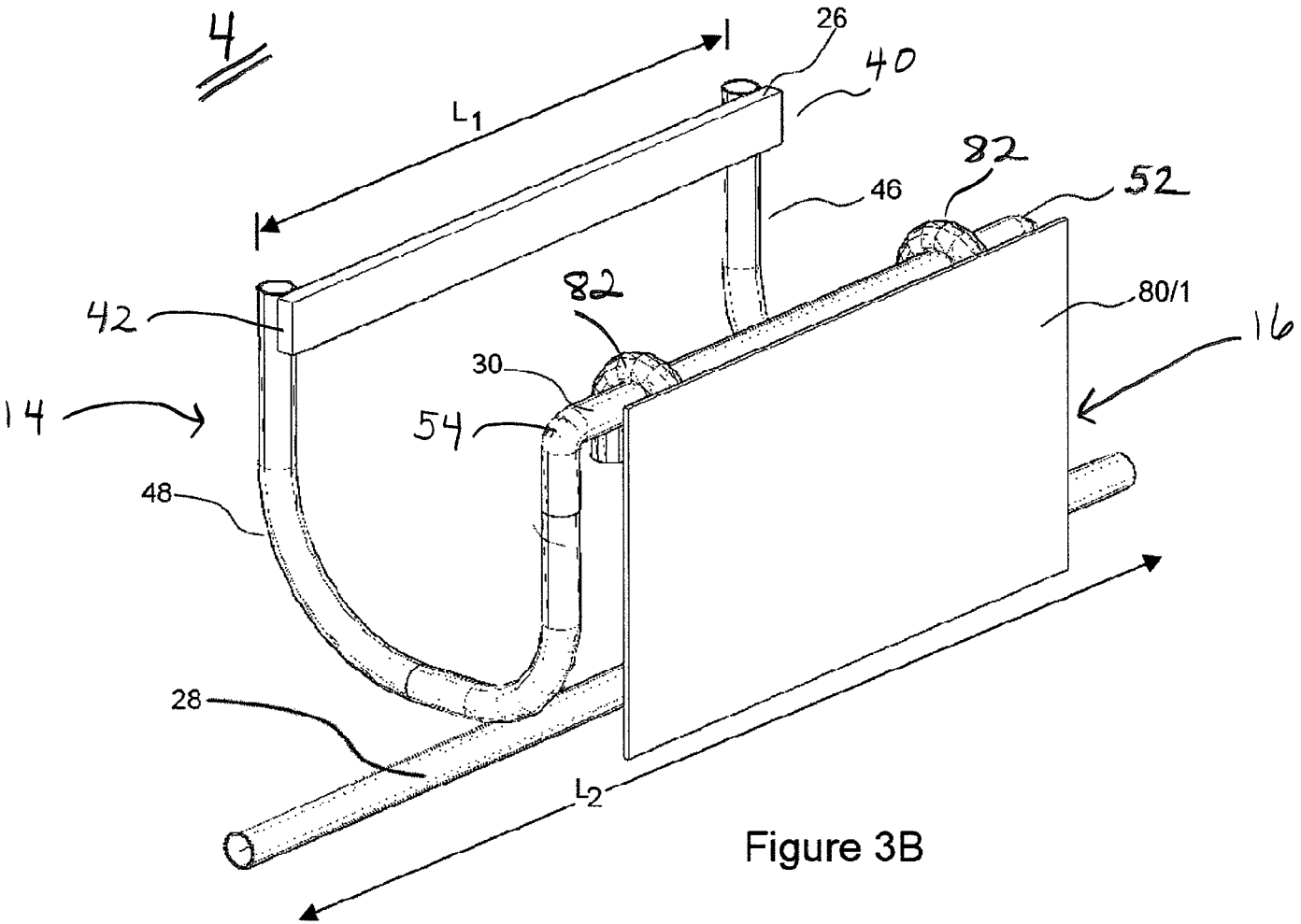
Figure 3C:
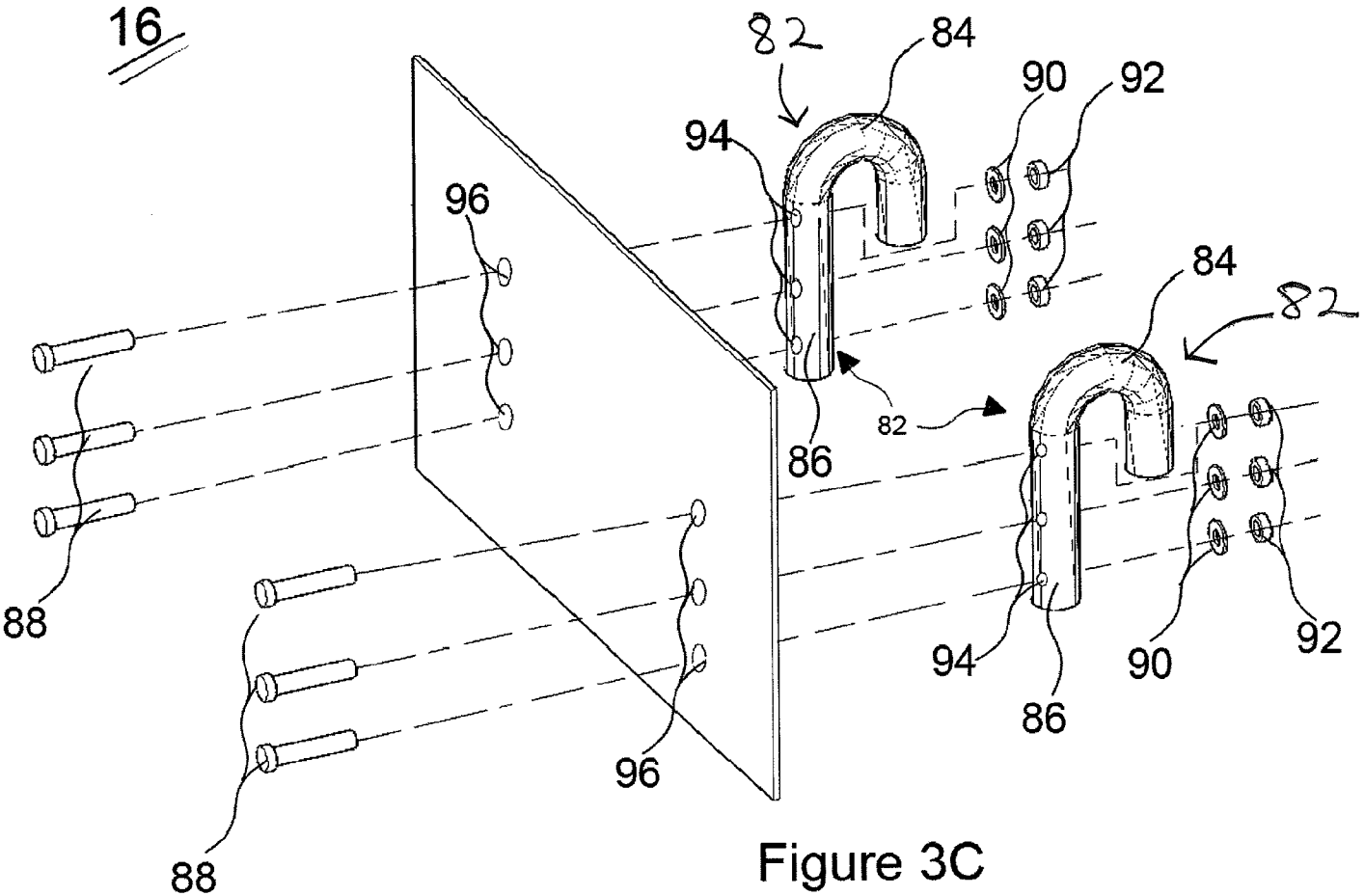
FIG. 3C is an exploded view illustrating details of an exemplary assembly of the brackets and backerboard shown in FIGS. 3A and 3B.
Figure 4:
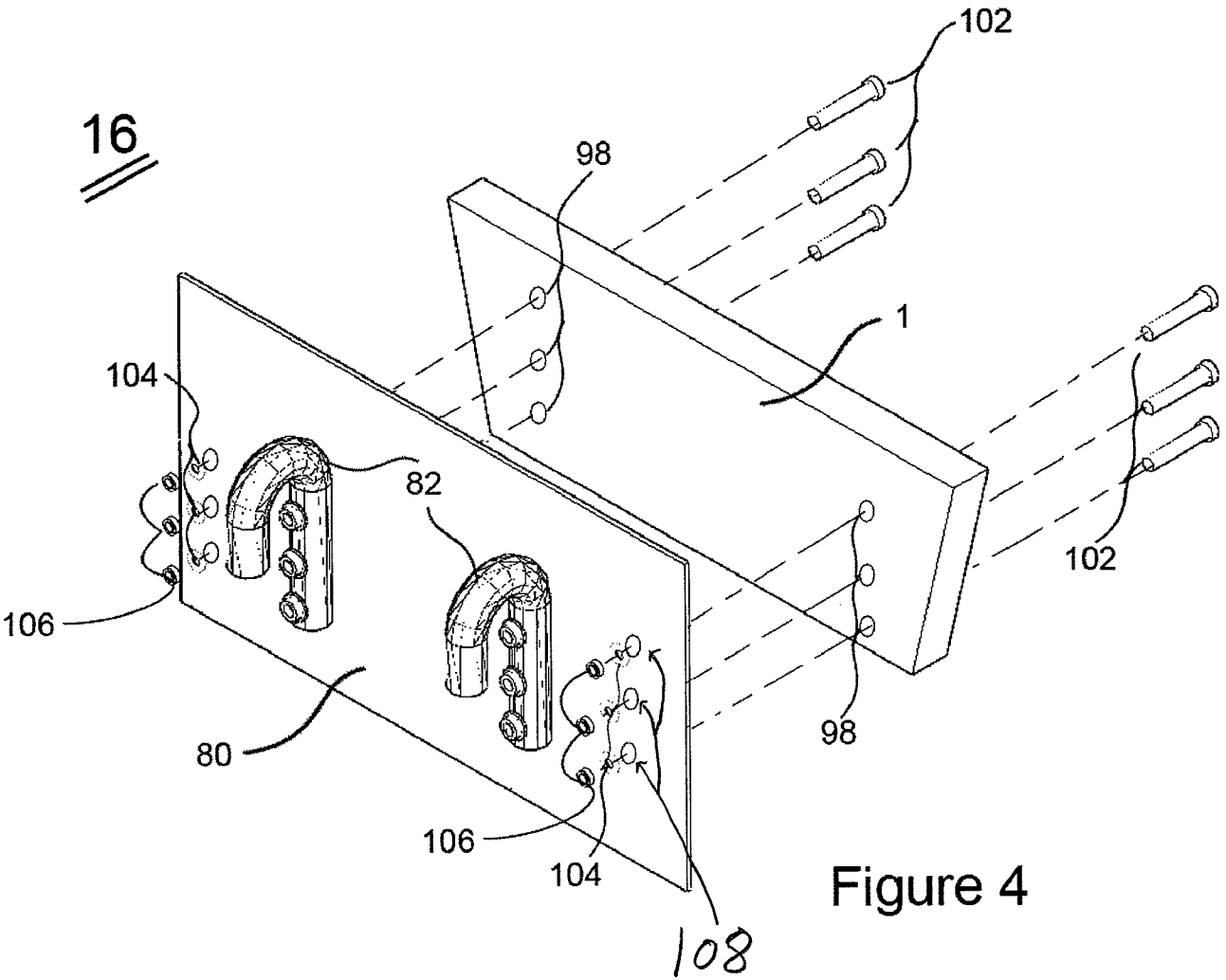
FIG. 4 is another exploded view of the brackets and backerboard shown in FIG. 3, further illustrating attachment of a hangboard to the brackets with the backerboard positioned between the brackets and the hangboard.

In accord with an embodiment of the invention, FIGS. 2, 3 and 4 illustrate a removable assembly 4 (see, especially, FIGS. 3A and 3B) for temporary mounting of an exercise device about a door opening 6 of width W formed along an interior wall 8 of a building. The mounting provides for hanging of the device above, for example, a horizontal floor 10. For this exemplary embodiment the exercise device is a hangboard 1, it being understood that the hangboard may be a fingerboard or other suitable fitness device. The device 1 may be positioned in the opening 6 with an assembly according to the invention. The illustrated opening 6 includes customary door trim along vertical sides and the top of the opening, but other designs of walk through openings can also accommodate the assembly 4.

An assembly 4 according to the invention includes first and second connectable units 14 and 16. The view of FIG. 2A illustrates attachment of the first unit 14 over and against a horizontal length of door trim 18. The trim 18 is positioned above the opening 6 and along a first side 20 of the wall 8. FIG. 2B illustrates the first unit 14 of the assembly 1 in a view along a second side 22 of the wall 8 (opposite the first side 20 of the wall 8) with the unit 14 positioned against the side 22. As will be more apparent from the illustrations of FIG. 3, with the benefit of gravity, the first 14 unit hangs from the door trim 18 while pressing against the second side 22 of the wall 8, e.g., against vertical wall trim. Generally, the first unit 14, by itself, can easily be attached to the wall 8 without use of fasteners about the opening 6 and the second unit 16, to which the hangboard 1 is to be attached, can be hung from the first unit 14. It is also noted that the door opening is shown without illustration of a door. An associated door may be hinged to open and close about the opening 6 or may be a sliding door. In the illustrated embodiments, a swing door may be hinged to open into the room along which the wall side 20 is formed to avoid interference when pressing the first unit 14 against the second side 22 of the wall. The unit 14 can be mounted in the opening 6 and removed from the opening quickly and repeatedly without compromising the integrity of the mounting and without removal of screws, bolts and the like. With reference to the front and rear perspective views of the assembly 4, as shown in FIGS. 3A and 3B, the second unit 16 is shown connected to the first unit 14. The first unit 14 comprises first, second and third bar sections 26, 28 and 30 rigidly connected to one another. When the first unit 14 is attached to the wall 8, these bar sections have horizontal orientations with respect to the floor 10. The first bar section 26 is spaced from the second bar section 28 so that when the first bar section 26 is placed over and against the horizontal door trim 18, above the opening 6 on the side 20 of the adjoining wall, the second bar section 28 extends across the opening on the other side 10 of the adjoining wall 8 and rests against the wall 8, e.g., against vertical trim pieces 34, 36 which extend along the opening on the side 22 of the wall 8. The third bar section 30 is positioned above the second bar section 28. In the illustrations of FIGS. 2, 3 and 4, the third bar section 30 is also shown to be higher in elevation than the first bar section 26, so that when the unit 14 is installed in the opening 6, the third bar section 30 is above the top of the opening 6. In other designs the third bar section 30 may be higher or lower depending on desired elevation of the second unit 16 relative to the floor 10.

Also as shown in the figures, the first bar section 26 and the third bar section 30 may have substantially the same lengths $L_1$, both smaller than the width, W, of the opening 6. This relationship facilitates positioning of the bar sections about the opening. The second bar section 28 is of length $L_2$ which is substantially greater than the width, W, of the opening 6 to assure secure contact against the wall 8 when the first unit 14 is mounted thereon. By way of example, with the width W of the opening at 30 inches (approx. 76 cm), $L_1$ may be 26-29 inches (approx. 66-74 cm) and $L_2$ may be 36 inches (approx. 91 cm) so that each opposing end 40, 42 of the second bar section 28 extends at least three inches along the side 22 of the wall 8. In order for the assembly to operate with a wide range of opening widths W, the second bar section may have an even greater length to suit larger openings or door frame sizes, but may extend less than three inches along the side 22 of the wall 8.

Rigid connection between the first, second and third bar sections 26, 28 and 30 is effected with connecting sections 46 and 48 each positioned for attachment to different ends of the horizontal bar sections 26 and 30. With respect to the first and second opposing ends 40 and 42 of the first bar section 26, and with respect to the first and second opposing ends 52 and 54 of the bar section 30, the connecting section 46 extends from an attachment point 60 at the first end 40 of the first bar section 26 to the first end 52 of the bar section 30. Similarly, the connecting section 48 extends from an attachment point 62 at the second end 42 of the first bar section 20 to the second end 54 of the third bar section 30. The bar section 28 is attached at two spaced apart points 76, 78 to the connecting sections 46, 48, e.g., with conventional fasteners, by welding or other fabrication techniques or processes. However, all of the illustrated sections of the first unit 14 may be formed as one continuous series of tubing without fasteners, or may be formed in segments which can be screwed, clamped or otherwise coupled together, e.g., in a mating fashion or with fasteners. Thus, as shown in FIGS. 3A and 3B, the connecting sections 46 and 48 may be attached to the bar section 30 with ninety degree couplings which each mate with the bar section 30 and other portions of the sections 46 and 48.

With further reference to FIGS. 3A and 3B, according to one embodiment the second unit 16 comprises a backerboard 80 to which the hangboard is to be attached and a pair of brackets 82 suitable for attachment of the backerboard to the first unit 14. The backerboard may be cut in a shape similar to that of the hangboard and may be cut to a size similar to the size of the hangboard 1. The backerboard 80 may be somewhat smaller or somewhat larger than the hangboard that is to be mounted to it. The backerboard may be formed of plywood or other laminate material and, depending on the strength and resilience of the chosen laminate material, may be of a thickness in the range of 0.34 inch to more than 0.75 inch (i.e., 85-190 mm, approx). The backerboard 80 may also be formed from a sheet of metal. Although not shown in the figures, the backerboard 80 may have an array of predrilled holes to accommodate a variety of hangboards having different hole configurations so that fasteners may pass through the backerboard and into holes in the hangboard in order to attach the hangboard to the brackets 82.

As further shown in the exploded view of the second unit 16 shown in FIG. 3C, the brackets may be "U" shaped or hook-like tubes each having a curved portion 84 for hanging engagement with the third bar section 30 of the first unit 14, and a section 86 suitable for attachment to the backerboard with two or more conventional fasteners such as the illustrated sets of bolts 88, washers 90 and nuts 92. The brackets 82 each have corresponding holes 94 and the backerboard includes complementary holes 96. The bolts 88 pass through the series of holes 94 and 96 to secure the backerboard 80 to the brackets 82.

Figure 5:
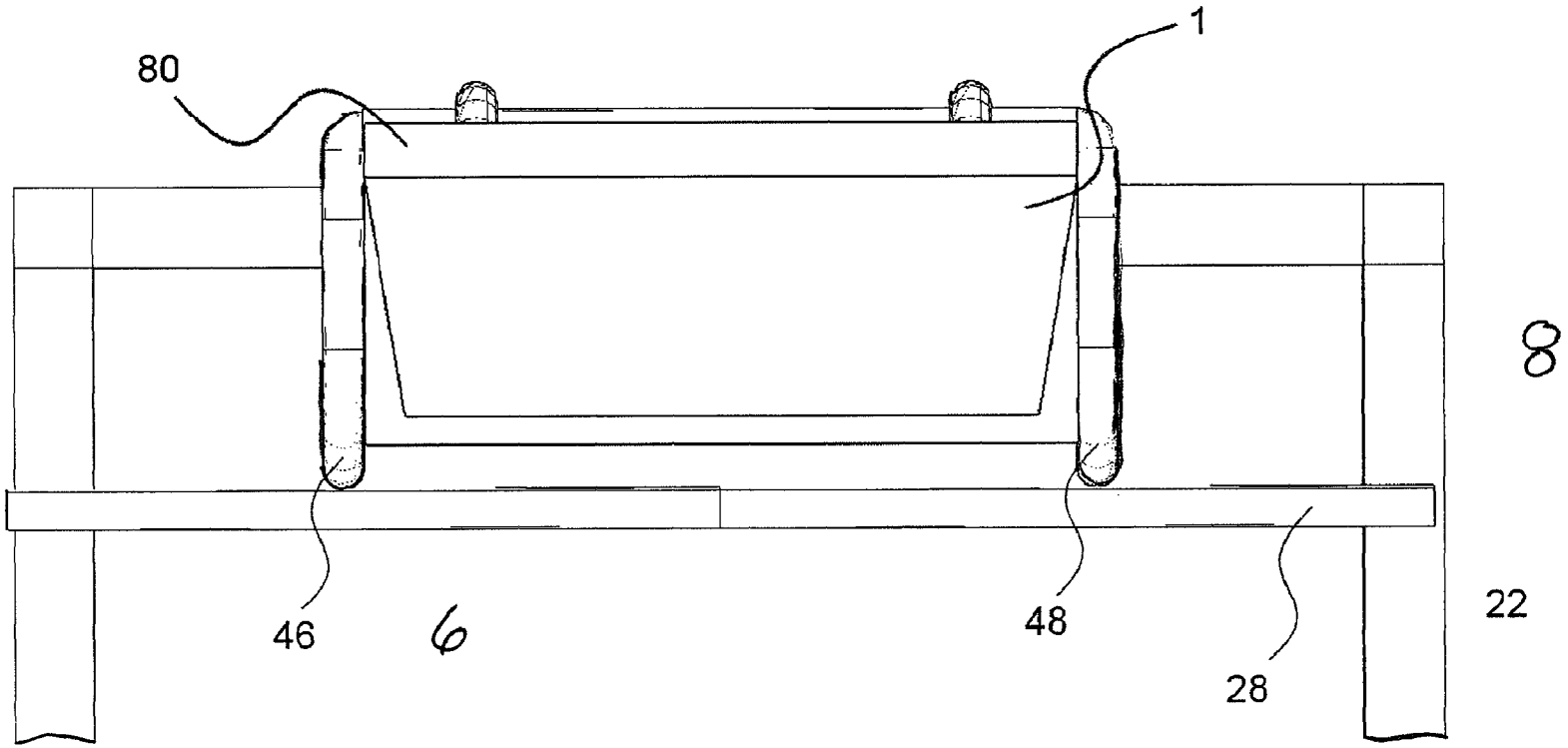
FIG. 5 is an elevation view of the assembly shown in FIGS. 2, 3 and 4 fully assembled and mounted in the wall opening.

As illustrated in the exploded view of FIG. 4, the hangboard 1 can be securely attached to the backerboard 80 of the second unit 16 with additional fasteners. Commonly, many hangboards are already manufactured with through holes for mounting on a wall as described with respect to FIG. 1. As shown in FIG. 4, such holes 98 can also be used to mount the hangboard 1 to the backerboard 80 with sets of bolts 102, washers 104 and nuts 106. The bolts 102 pass through the holes 98 and further holes 108 of the backerboard 80. With the hangboard 1 attached to the second unit 16 and the brackets 82 used to hang the second unit 16 from the first unit 14 in the opening 6, the hangboard 1 is shown in FIG. 5 deployed for an exercise routine, i.e., mounted about the opening 6 along the wall 8. That is, with the first bar section 26 placed over the horizontal door trim 18 (see FIG. 2A), the second bar section 28 is positioned across the opening 6 so that the first unit 14 is fixed in place about the opening. The combination of the backerboard 80 and the hangboard 1 hang from the first unit 14 as more fully shown in FIG. 3.

Figure 6A:
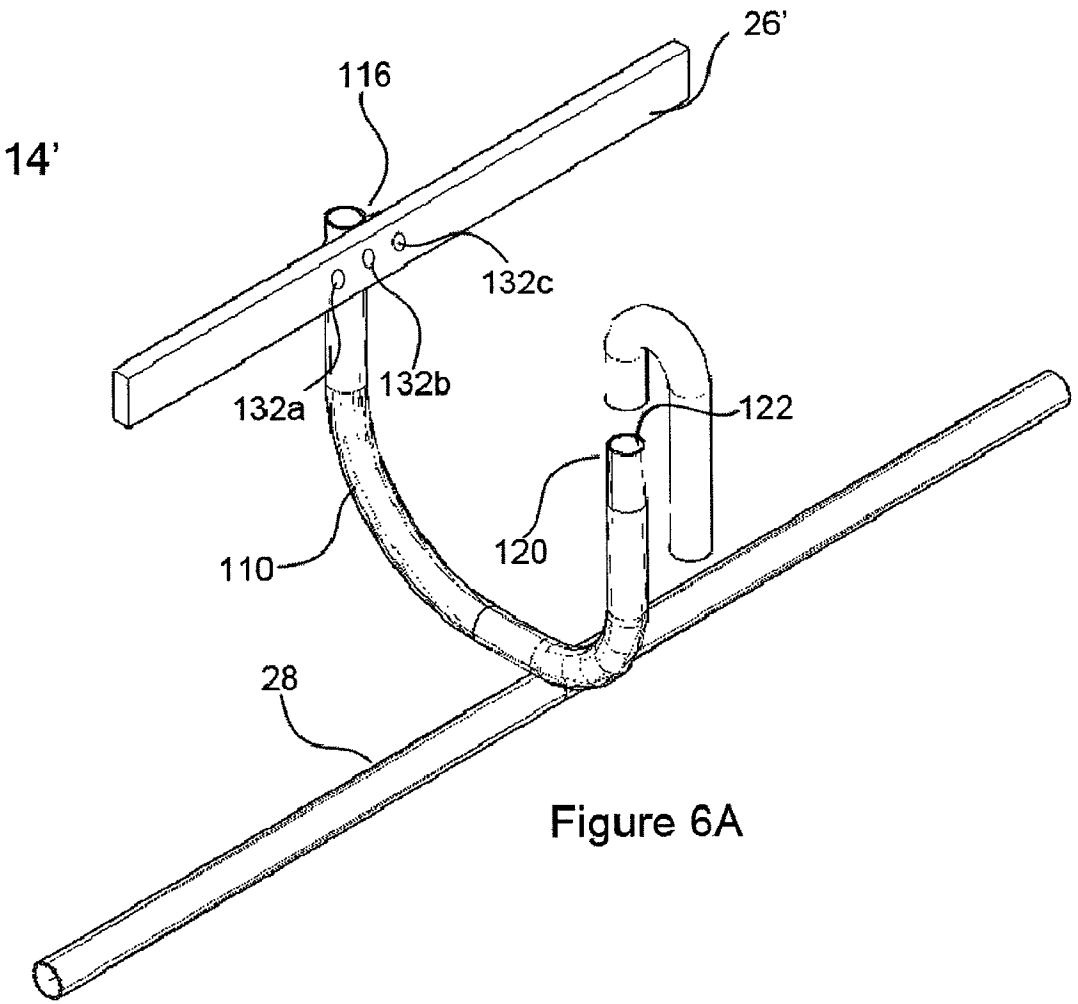
FIGS. 6A, 6B and 6C illustrate an exemplary alternate embodiment of the removable assembly where
Figure 6B:
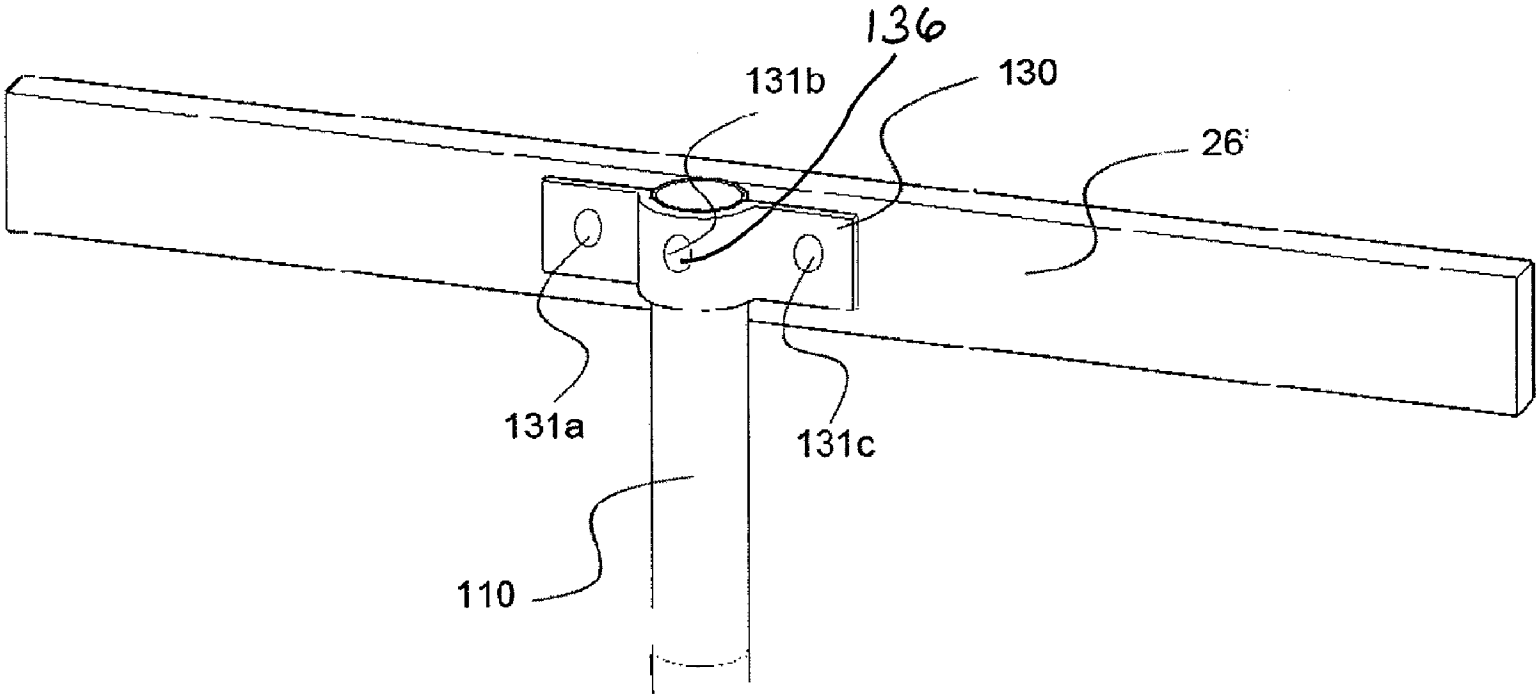
Figure 6C:
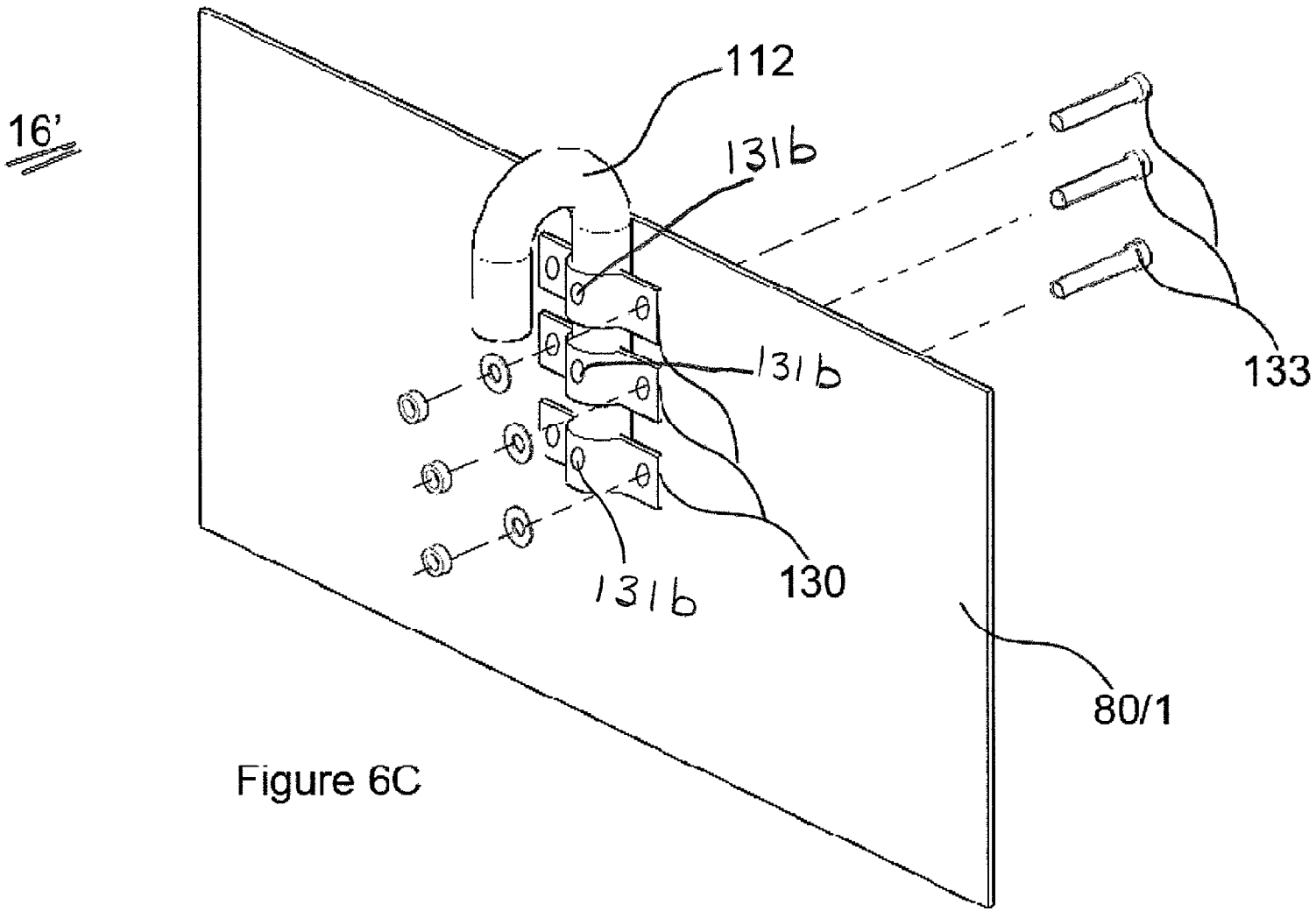
Figure 6D:
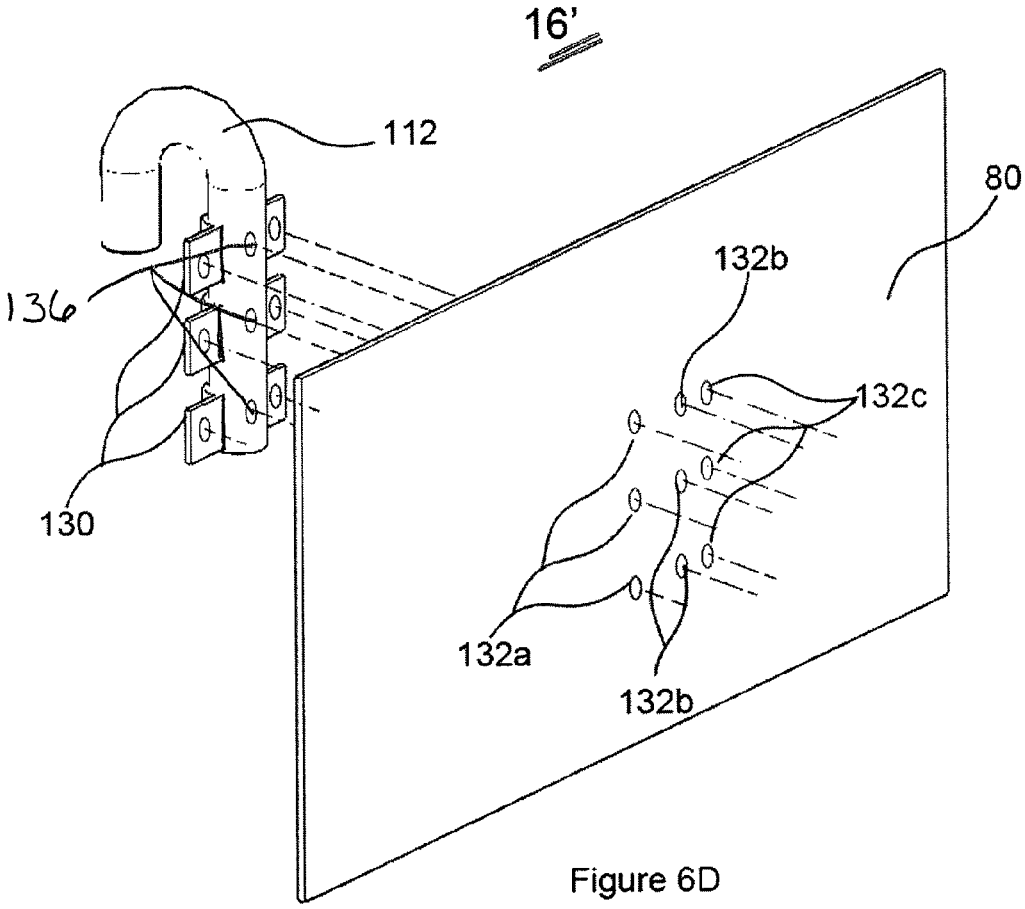
FIG. 6D is an exploded view of the second unit illustrating details thereof.

In an exemplary alternate embodiment of the assembly 1 shown in FIG. 6, the first and second units 14 and 16 are modified as indicated by the first unit 14' shown in the perspective views of FIGS. 6A and 6B and the second unit 16' shown in the perspective view of FIG. 6C and the exploded view of FIG. 6D. The unit 14' is constructed with a single, centered connecting section 110 in lieu of the pair of connecting sections 46, 48 of the unit 14. The section 110 is attached to a first bar section 26' similar in function to the bar section 26, which is to be placed over the horizontal segment of door trim 18 as shown for the bar section 26 in FIG. 2A. Details of the attachment between the connecting section 110 and the first bar section 26' are shown in the partial view of FIG. 6B. The second unit 16' includes one bracket 112 instead of the two brackets 82 of the unit 16. In this embodiment, the connecting section 110 extends from a first end 116 connected to the first bar section 26' and has the second bar section 28 fastened thereto in a manner like that of the embodiment of FIG. 3 (e.g., with conventional fasteners, clamps, couplings, welds, etc). The connecting section 110 continues past the bar section 28 in an upward sweep with a second end 120 of the connecting section 110 having an opening 122 to receive the bracket 112. The bracket 112 can be similar in shape to one of the brackets 82 and mounted to the backerboard in a similar manner. Generally, with insertion of one of the connecting section 110 or the bracket 112 into the other, the bracket 112 becomes engaged to the first unit 14' in a releasable coupling relationship for support of the hangboard 1 by the first unit 14'.

In the illustrations of FIGS. 6B, 6C and 6D, the bracket 110 is connected to the first bar section 26' with a collar 130 and the bracket 112 is connected to the backerboard 80 with a series of the collars 130. The collars 130 each have a pattern 131 of three holes 131*a*, 131*b* and 131*c* extending therethrough to effect attachment to a connecting section 110 or the bracket 112. Attachments with the collars 130 effects secure connection between the connecting section 110 and the bar section 26'; and between the bracket 112 and the backerboard 80. A center hole 131*b* in each of the three hole patterns 131 of a collar 130 is aligned with a center hole 132*b* in each of a complimentary series 132 of three holes 132*a*, 132*b*, 132*c* in a central region of the bar section 26' or the backerboard 80. The three hole pattern 132 in the bar section 26' is used to attach the connecting section 110 to the bar section 26' by passing bolts through the holes in a collar 130 and the series 132 of holes in the bar section 26'.

With the connection section 110 placed between the collar and the bar section 26', a bolt 133 is passed through a hole 131*b* of the collar, a hole 136 in the connection section 110 and a hole 132*b* in the bar section 26' wherein the holes 131*b*, 136 and 132*b* are aligned with one another. Similarly, with the bracket 112 placed between each of three collars 130 and the backerboard 80, a bolt 133 is passed through a hole 131*b* of the collar, through a hole 136 in the bracket 112 and through a hole 132*b* in the backerboard 80 wherein the holes 131*b*, 136 and 132*b* are aligned with one another.

In summary, with reference to FIGS. 6C and 6D, for each of the three-hole patterns 132 formed in the bar section 26' or the backerboard 80, the center hole 131*b* formed in the collar 130 is positioned in alignment with a through-hole 136 in the bracket 112 and in further alignment with the hole 132*b* (i.e., a middle one of the holes in the three hole pattern 132 in the backerboard 80). Thus, with the collars 130 each having a hole 130*a* on one side of the hole 130*b* and a hole 130*c* on another side of the hole 130*b*, each collar is secured to the backerboard with bolts 133 passing through the holes 130*a* and 130*c*, and the bracket 112 is locked into position via a bolt passing through the collar hole 130*b*, passing the through the bracket through-hole 136 and the middle one of the holes, hole 132*b*, in each series 132 of three holes in the backerboard 80.

The bracket 112 may be slotted to fit within or around the bracket 110. In the illustration of FIG. 6, the connection section 110 and brackets 112 are of tubular shapes with the bracket 112 sized to fit snugly within the bracket 110. In other designs the connection section 110 and brackets 112 may have rectangular, square or other mating shapes with one member locking inside the other to prevent rotational movement. A similar approach can be applied to an assembly comprising two brackets 112.

For the embodiment shown in FIG. 6 when the assembly is mounted in a door opening over a horizontal floor surface, with the bar section 28 positioned across the opening and against the second side of the wall, while the bar section 26' is positioned over the strip and against the first side of the wall, the connecting section 110 is in a vertical orientation with respect to the floor surface.

Figure 7:
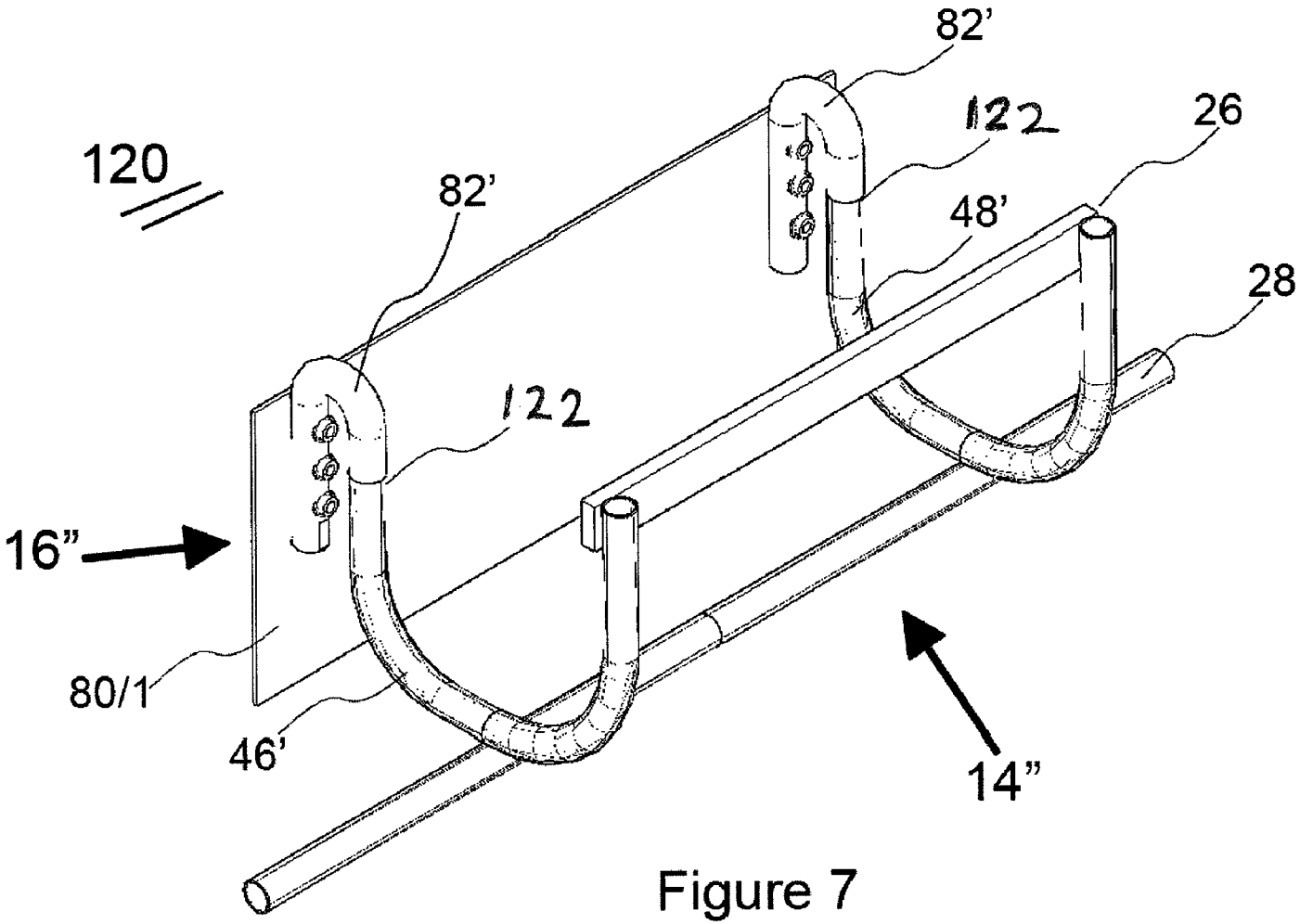
FIG. 7 is a perspective view illustrating a removable assembly according to still another embodiment of the invention.

In FIG. 7 there is illustrated an assembly 120 according to another embodiment of the invention, wherein the connecting sections 46, 48 of the unit 14 are replaced with sections 46' and 48' to provide a unit 14" with each section 46', 48' having an open end 122 instead of a connection to the third bar section 30. Also, instead of the brackets 82, configured to hang on the third bar section 30, the unit 16" has a pair of similarly shaped tubular brackets 82' which fit within the open ends 122 (as shown) or around the sections 46' and 48'. The backerboard 80 is attached to the brackets 82' in a manner similar to that described for the brackets 82 in FIG. 3. More generally, the open ends 122 of the connecting sections 46', 48' may be configured as attachment portions, each sized to effect a sliding inserting relationship with an end of a tubular bracket 82' so that with insertion of one of the connecting sections 46', 48' or the bracket 82' into the other, the bracket 82' becomes engaged to the first unit 14" in a releasable coupling relationship for support of the hangboard by the first unit 14". For both the embodiment of FIG. 6 and the embodiment of FIG. 7, the releasable coupling relationship between members can be secured with a ring clamp or other tightening mechanism where the surface of the outer member, e.g., the connecting section 46' or 48', is clamped or tightened against the inner member, e.g., the bracket 82'. To effect this, the outer member may include a slot extending from the open end to provide spring-like resilience to the outer member. Accordingly, when the clamping force is released, the outer member expands.

FIG. 3 also indicate an alternate embodiment where it is recognized that the unit 16 can be customized for a specific design of a hangboard, thereby eliminating the backerboard 80 from the assembly. For example, if the mounting hole pattern of the hangboard device 1 is predetermined, the brackets 82 can be fabricated with through holes that align with the mounting holes on the hangboard 1. Accordingly, as indicated in FIG. 3 by use of alternate reference numerals 80/1, the assembly 4 does not require use of the backerboard 80 and the hangboard device 1 may be fastened directly to the brackets 82. Otherwise, the arrangement of the assembly is essentially the same as described with use of the backerboard. Similarly, for the assemblies shown in FIGS. 6 and 7, the bracket 112 and the brackets 82' may be fastened directly to a hangboard 1, thereby eliminating the need for the backerboard 80.

For numerous embodiments according to the invention it may be desirable to provide such assemblies in kit form or in form requiring assembly. Accordingly, descriptions for such assemblies may be made with reference to individual members of the assembly being configured for attachment to one another. The term "configured for attachment" as used herein is with reference to a specific relationship among components when they are assembled as described, e.g., in one of the deployed configurations shown for various embodiments in the figures.

While the present invention has been described with reference to preferred embodiments, it will be understood by those skilled in the art that various changes may be made and equivalent elements may be substituted for the elements thereof without departing from the scope of the invention. For example, while numerous components have been described as members, certain of the members may be formed of multiple segments that can be linked together. Also, while several methods of attachment have been described to couple members to one another, it will be apparent to those skilled in the art that other methods of attachment can be used to form a removable assembly in keeping with the principals disclosed herein. The scope of the invention further includes any combination of elements from the various embodiments set forth herein. Numerous modifications may be made to adapt the removable assembly to particular situations without departing from the scope of the invention. For example, the aforedescribed embodiments of removable assemblies may be applied to an opening in a wall which does not have door trim or the like by placement of a support member above the opening on one side of the wall. It is intended that the invention not be limited to the particular embodiments disclosed, but that the invention will include all embodiments falling within the scope of the claims which follow.

The invention claimed is:

1. A removable assembly for providing temporary mounting of a hangboard in a walkthrough opening, such as a doorway formed along a wall comprising first and second opposing sides, the wall including a supportive strip positioned above the opening along the first side of the wall, the removable assembly comprising:

a first unit; and at least a first bracket for connecting the hangboard to the first unit, wherein the first unit includes:

a first member configured to be placed over the strip and along the first side of the wall when mounting the hangboard;

a second member, for attachment to the first member when the assembly is in a deployed configuration wherein, when attached to the first member while the assembly is installed in the walkthrough opening, the second member is positioned across the opening and against the second side of the wall while the first member is positioned over the strip; and a third member configured for attachment to the first and second members to effect the deployed configuration so that, when the first member is positioned over the strip and the second member is positioned against the second side of the wall and when the assembly is installed in the walkthrough opening and when a load is applied to the third member, a force is transferred to the wall; and wherein the first bracket comprises a first attachment portion configured to support the hangboard and a second attachment portion configured for releasable coupling to the third member for support of the first bracket so that when (i) the first unit is positioned with the first member over the strip and the second member against the second side of the wall, (ii) and the hangboard is attached to the bracket via the first attachment portion, (iii) and the bracket is coupled to the third member via the second attachment portion:

the hangboard is supported by the first unit with the second attachment portion of the bracket supported by the third member.

2. The assembly of claim 1 wherein, in the deployed configuration, a portion of the third member is positioned above the second member.

3. The assembly of claim 2 wherein the portion of the third member positioned above the second member includes a segment for directly receiving a load from the hangboard via the first bracket and wherein, when the assembly is mounted in a door opening over a horizontal floor surface, with the second member positioned across the opening and against the second side of the wall, while the first member is positioned over the strip and against the first side of the wall: the segment of the third member is in a vertical orientation with respect to the floor surface.

4. The assembly of claim 1 wherein the second attachment portion of the first bracket includes an end portion sized to effect a sliding inserting relationship with an end of the third member and the bracket so that, with insertion of one of the bracket or the third member into the other, the bracket becomes engaged to the first unit in a releasable coupling relationship for support of the hangboard by the first unit.

5. The assembly of claim 1, with the first unit further including at least a fourth member also configured for attachment to the first and second members to effect the deployed configuration so that, when the first member is positioned over the strip and the second member is positioned against the second side of the wall, a load is transferable through the third and fourth members to the wall.

6. The assembly of claim 5 wherein the second attachment portion of the first bracket includes an end portion sized to effect a sliding inserting relationship with an end of the third member and the bracket so that with insertion of one of the bracket or the third member into the other the bracket becomes engaged to the first unit in a releasable coupling relationship for support of the hangboard by the first unit.

7. A removable assembly for providing temporary mounting of a hangboard in a walkthrough opening formed along a wall having first and second opposing sides extending to a floor, the wall including a supportive strip positioned above the opening along the first side of the wall, the removable assembly comprising:

a first unit; and first and second brackets connecting the hangboard to the first unit, wherein the first unit includes:

a first member configured to be placed over the strip and along the first side of the wall when mounting the hangboard;

a second member attached to the first member wherein the second member can be fixedly positioned across the opening and against the second side of the wall when the first member is positioned over the strip; and a third member attached to the second member such that when the first member is placed over the strip and the second member is positioned against the second side of the wall, at least a portion of the third member is positioned above the second member;

at least a pair of fourth members, each connecting the first, second and third members to one another so that, when the first member is positioned over the strip and the second member is positioned against the second side of the wall, a load is transferable from the third member through the fourth members to the wall; and wherein the first and second brackets each comprise a first attachment portion configured to support the hangboard and each bracket comprises a second attachment portion configured for releasable coupling to the third member for support of the bracket so that when (i) the first unit is positioned with the first member over the strip and the second member against the second side of the wall, (ii) and the hangboard is attached to the brackets via the first attachment portions, (iii) and the brackets are coupled to the third member via the second attachment portion, the hangboard is supported by the first unit with the second attachment portions of the brackets supported by the third member, with attachment of the hangboard being effected with direct attachment to the brackets or attachment to the brackets via a backerboard positioned between the hangboard and the brackets.

8. A method of providing a removable assembly for temporary mounting of a hangboard in a walkthrough opening formed along a wall having first and second opposing sides, the wall including a supportive strip positioned above the opening along the first side of the wall, the method comprising:

providing a first unit and providing at least a first bracket for connecting the hangboard to the first unit, wherein providing the first unit includes:

providing a first member configured for placement over the strip and along the first side of the wall when mounting the hangboard;

providing a second member configured for attachment to the first member in a deployed configuration wherein the second member can be positioned across the opening and against the second side of the wall while the first member is positioned over the strip;

providing a third member configured for attachment to the second member in the deployed configuration such that when the first member is placed over the strip and the second member is positioned against the second side of the wall, at least a portion of the third member is positioned above the second member; and providing at least a fourth member, configured to connect the first, second and third members to one another to effect the deployed configuration so that, when the first member is positioned over the strip and the second member is positioned against the second side of the wall, a load is transferable from the third member through the fourth member to the wall; and wherein providing the first bracket includes providing a first attachment portion on the bracket configured to support the hangboard and providing a second attachment portion on the bracket configured for releasable coupling to the third member for support of the first bracket so that when (i) the first unit is positioned with the first member over the strip and the second member against the second side of the wall, (ii) and the hangboard is attached to the bracket via the first attachment portion, (iii) and the bracket is coupled to the third member via the second attachment portion:

the hangboard is supported by the first unit with the second attachment portion of the bracket supported by the third member with attachment of the hangboard being effected with direct attachment to the bracket or attachment to the bracket via a backerboard positioned between the hangboard and the bracket.

* * * * *